US011022317B2

(12) United States Patent
Lu et al.

(10) Patent No.: US 11,022,317 B2
(45) Date of Patent: Jun. 1, 2021

(54) MOVABLE BURNER OF GAS COOKTOP AND GAS COOKTOP

(71) Applicant: BSH Hausgerate GmbH, Munich (DE)

(72) Inventors: Yong Lu, Nanjing (CN); Junhui Xing, Nanjing (CN); Qingsong Xie, Nanjing (CN); Xiaofeng Yin, Nanjing (CN)

(73) Assignee: BSH Hausgeräte GmbH, Munich (DE)

( * ) Notice: Subject to any disclaimer, the term of this patent is extended or adjusted under 35 U.S.C. 154(b) by 6 days.

(21) Appl. No.: 16/589,167

(22) Filed: Oct. 1, 2019

(65) Prior Publication Data

US 2020/0132308 A1 Apr. 30, 2020

(51) Int. Cl.
*F24C 3/08* (2006.01)
*F24C 15/10* (2006.01)

(52) U.S. Cl.
CPC ..... *F24C 3/082* (2013.01); *F24C 15/107* (2013.01)

(58) Field of Classification Search
CPC ..... F24C 15/107; F24C 15/103; F24C 3/082
See application file for complete search history.

(56) References Cited

U.S. PATENT DOCUMENTS 4,313,416 A * 2/1982 Lau ..... F24C 15/102 126/39 E
4,435,638 A * 3/1984 Simon ..... H05B 3/76 126/39 E
6,978,777 B2 * 12/2005 Pestrue ..... F24C 3/14 126/25 AA
2009/0090345 A1 * 4/2009 Reischmann ..... F24C 15/36 126/24
2016/0348917 A1 * 12/2016 Johncock ..... F23D 14/00

FOREIGN PATENT DOCUMENTS

| | | | | |
|---|---|---|---|---|
| CN | 2190244 Y | * | 2/1995 | |
| CN | 210485044 U | * | 5/2020 | |
| CN | 111594878 A | * | 8/2020 | |
| CN | 112146129 A | * | 12/2020 | |
| JP | 4146494 B1 | * | 9/2008 | ..... F24C 15/107 |
| KR | 200438941 Y1 | * | 3/2008 | |
| WO | WO-2008101766 A1 | * | 8/2008 | ..... H05B 6/1272 |
| WO | WO2020258739 A1 | * | 12/2020 | |

* cited by examiner

*Primary Examiner* — Avinash A Savani
*Assistant Examiner* — Deepak A Deean
(74) *Attorney, Agent, or Firm* — Michael E. Tschupp; Andre Pallapies; Brandon G. Braun

(57) ABSTRACT

A movable burner of a gas cooktop includes a rotating shaft, a linear motion mechanism configured to perform a linear motion, a burner head, and a limit unit configured to limit a stroke range of the linear motion mechanism. The burner head includes a plurality of brackets having a plurality of gas outlets for gas to flow out and form a flame. Each bracket is separately hinged to the rotating shaft and separately connected to the linear motion mechanism such as to execute a rotation about the rotating shaft between at least two working positions, when driven by the linear motion mechanism, with the burner head having a flat upper surface in one of the two working positions, and with the burner head having a concave configuration in the other one of the two working positions.

24 Claims, 11 Drawing Sheets

MOVABLE BURNER OF GAS COOKTOP AND GAS COOKTOP

CROSS-REFERENCES TO RELATED APPLICATIONS

This application claims the priority of Chinese Patent Application, Serial No. 201821789602.X, filed Oct. 31, 2018, pursuant to 35 U.S.C. 119(a)-(d), the disclosure of which is incorporated herein by reference in its entirety as if fully set forth herein.

BACKGROUND OF THE INVENTION

The present invention relates to the technical field of cooktops, and in particular, to a movable burner of a gas cooktop and a gas cooktop.

A traditional gas cooktop typically includes a burner and a pot rack arranged around the burner. The pot rack is configured to support a pot and the burner is used as a heating source to heat foods in the pot. However, the structure design of the existing pot rack and burner is relatively single, and cannot match well with pots with changeable shapes. This affects use experience of users. As a result, a problem of a mismatch between the gas cooktop and the pot is caused, and there is a phenomenon that the pot cannot be placed on the gas cooktop stably, or that the pot is unevenly heated and has a poor heating effect, which affects use experience of users.

BRIEF SUMMARY OF THE INVENTION

A purpose of embodiments of the present invention is to provide an improved burner of a gas cooktop and a gas cooktop.

According to one aspect of the present invention, a movable burner of a gas cooktop includes a rotating shaft, a linear motion mechanism configured to perform a linear motion, a burner head having a plurality of brackets including a plurality of gas outlets for gas to flow out and form a flame, each of the brackets being separately hinged to the rotating shaft and separately connected to the linear motion mechanism such as to execute a rotation about the rotating shaft between at least two working positions, when driven by the linear motion mechanism, with the burner head having a flat upper surface in one of the two working positions, and with the burner head having a concave configuration in the other one of the two working positions, and a limit unit configured to limit a stroke range of the linear motion mechanism.

Compared with an existing fixed burner, the burner head of the burner in accordance with the present invention can switch between a plurality of working positions to meet supporting and heating requirements of pots with different shapes. Specifically, the linear motion mechanism drives the bracket to change an angle, so as to implement a switch of the burner head between different working positions. Therefore, advantages of simple solutions, low costs, low structure complexity, and easy manufacture are achieved. Further, each of the brackets remains in the corresponding working position due to the presence of the limit unit to provide a stable supporting structure, so as to avoid overturning of a pot supported on the bracket due to an unexpected displacement of the bracket during a use process. Further, the bracket remains in different working positions, so that the burner head can be made into different shapes to adapt to pots with different shapes and calibers.

According to another advantageous feature of the present invention, the linear motion mechanism can include a linear motor, a helical linear motion mechanism, or a linear motion mechanism with a connecting rod. In this way, the bracket may be effectively driven to rotate up and down about the rotating shaft along a vertical direction, so that the bracket can switch between different working positions with a shortest motion mileage.

According to another advantageous feature of the present invention, the linear motion mechanism can include a driving portion, a transmission shaft defining an axis and driveable by the driving portion for rotation about its own axis, the transmission shaft having first and second ends that are opposite to each other along a length direction, with the first end coupled with the driving portion, a transmission portion sleeved on the transmission shaft and executing an up and down motion in the length direction along the transmission shaft as the transmission shaft rotates, a fixing unit coupled to the transmission portion to limit a rotation of the transmission portion, when the transmission shaft is caused to rotate, and a plurality of supporting rods, each of the supporting rods having first and second ends that are opposite to each other along a length direction, with the first end being directly or indirectly hinged to the transmission portion, and with the second end of each of the supporting rods being hinged to a corresponding one of the brackets. In this way, a rotational motion of the transmission shaft is transformed into a linear motion of the transmission portion through the cooperation of the components, and the linear motion is transmitted to the bracket through the supporting rod. Further, overall structure complexity of the linear motion mechanism is low, the driving portion, the transmission shaft, the transmission portion, the fixing unit, and the supporting rod can be combined through a simple splicing method, and are easy to assemble, and a processing technology of the components is simple.

According to another advantageous feature of the present invention, the fixing unit can include a guiding pillar sleeved on a periphery of the transmission shaft and the transmission portion, with the guiding pillar provided with a groove along the length direction of the transmission shaft, and a pin portion having one end extending into a socket arranged in the transmission portion and capable of moving up and down in the groove while limiting the transmission portion from rotating when the transmission shaft is caused to rotate. In this way, a rotational motion of the transmission portion can be effectively transformed into a linear motion. Therefore, the structure is simple and easy to manufacture and assemble.

According to another advantageous feature of the present invention, the linear motion mechanism can include a slider sleeved on a periphery of the guiding pillar, with the slider being fixed with the transmission portion and caused to move up and down during the up and down motion of the transmission portion, wherein the first end of the supporting rods is hinged to the slider. In this way, a linear motion trend of the transmission portion can be transmitted to the supporting rod through the slider, and then an angle of the bracket can be adjusted.

According to another advantageous feature of the present invention, the slider can include a socket, with the pin portion passing through the socket of the slider and extending with the one end into the socket of the transmission portion to fix the slider with the transmission portion. In this way, a synchronous motion of the slider and the transmission portion can be implemented on the basis of making full use of the existing components, the number of overall components can be reduced, and assembly complexity can be reduced.

According to another advantageous feature of the present invention, the transmission portion can be configured as a trapezoidal nut, and the transmission shaft can have a trapezoidal thread coupled with the trapezoidal nut. In this way, a helical transmission effect can be achieved, so that a rotational motion of the transmission shaft can be transformed into a linear motion of the transmission portion.

According to another advantageous feature of the present invention, a housing can be arranged on a periphery of the linear motion mechanism, with the housing provided with a through hole for passage of the transmission shaft on one side near the driving portion. In this way, the linear motion mechanism can be protected by the housing, so that the linear motion mechanism can be prevented from being damaged by external force collision during a use process.

According to another advantageous feature of the present invention, a quantity of the supporting rods can be in accordance with a quantity of the brackets, with the second end of each of the supporting rods being hinged to a first hinge point of the corresponding one of the brackets, the linear motion mechanism being provided with a supporting portion on one end near the burner head, with the rotating shaft being fixed on the supporting portion and hinged to the brackets at a second hinge point of each of the brackets so that the linear motion of the linear motion mechanism causes a rotation of the first hinge point of each of the brackets about the second hinge point. In this way, with the linear motion of the linear motion mechanism, the angle of the bracket can be changed. Therefore, the bracket can switch between different working positions. Further, as the first hinge point of each of the brackets rotates about the second hinge point, one end of each of the brackets away from a burner head center can move in a direction away from or close to a panel of the gas cooktop. Therefore, a flat or a concave burner head is formed to stabilize and support pots with different shapes and calibers.

According to another advantageous feature of the present invention, the first hinge point can be located at a lower end of the corresponding one of the brackets, and the second hinge point can be located at one end of an upper surface of the corresponding one of the brackets near a center of the burner head. In this way, a length of the supporting rod can be reasonably shortened to reduce costs, and an effect that one end of the bracket away from the burner head center can rotate about another end close to the burner head center can be achieved.

According to another advantageous feature of the present invention, each bracket can have a protruded portion extending to the burner head center and provided with a through hole running through an upper surface and a lower surface of the protruded portion, the supporting portion being fixed with one end of the rotating shaft and extending into the through hole of the protruding portion to hinge the bracket to the rotating shaft. In this way, the supporting portion can pass through the bracket and be hinged to the inside of the bracket, so that the hinged position is not easily damaged by external forces This prolongs service life of the burner head.

According to another advantageous feature of the present invention, the limit unit can include micro switches respectively provided for the at least two working positions and configured to stop the linear motion of the linear motion mechanism, when being touched, so that the brackets remain in the corresponding one of the at least two working positions. In this way, the linear motion mechanism can automatically stop operation, so that after driven to move to a suitable working position, the bracket can automatically remain in the working position for users to use.

According to another aspect of the present invention, a gas cooktop includes a moveable burner as set forth above. In this way, the burner head of the gas cooktop can switch between a plurality of working positions, and can adapt to pots with different shapes and calibers.

BRIEF DESCRIPTION OF THE DRAWINGS

Other features and advantages of the present invention will be more readily apparent upon reading the following description of currently preferred exemplified embodiments of the invention with reference to the accompanying drawing, in which.

DETAILED DESCRIPTION OF EXEMPLARY EMBODIMENTS OF THE PRESENT INVENTION

Figure 1:
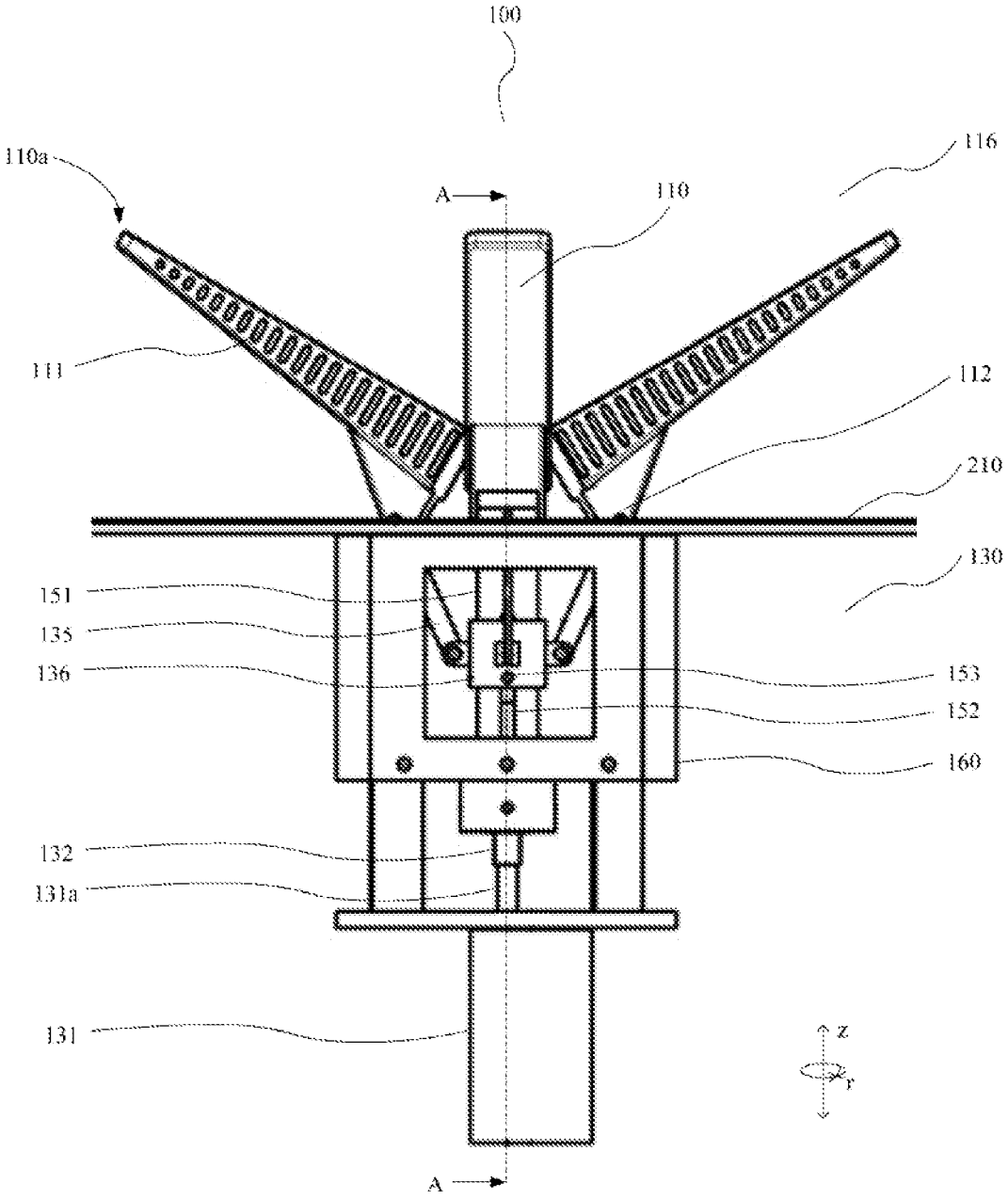
FIG. 1 is a schematic diagram of a movable burner of a gas cooktop in a first working position according to an embodiment of the present invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments may be illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a schematic diagram of a movable burner according to the present invention, generally designated by reference numeral 100 and forming part of a gas cooktop. In this exemplary embodiment, the burner 100 includes a burner head 116, which includes a plurality of brackets 110. Each of the brackets 110 is provided with a plurality of gas outlets 111 for gas to flow out and form a flame, and is separately hinged to a rotating shaft 120. The burner 100 further includes a linear motion mechanism 130, which is shown in greater detail in FIG. 3, and a limit unit which is configured to limit a stroke range of the linear motion mechanism 130. Each of the brackets 110 is separately connected to the linear motion mechanism 130. When the linear motion mechanism 130 performs a linear motion, each of the brackets 110 can be driven by the linear motion mechanism 130 to rotate about the rotating shaft 120, so that each of the brackets 110 has at least two working positions.

Figure 2:
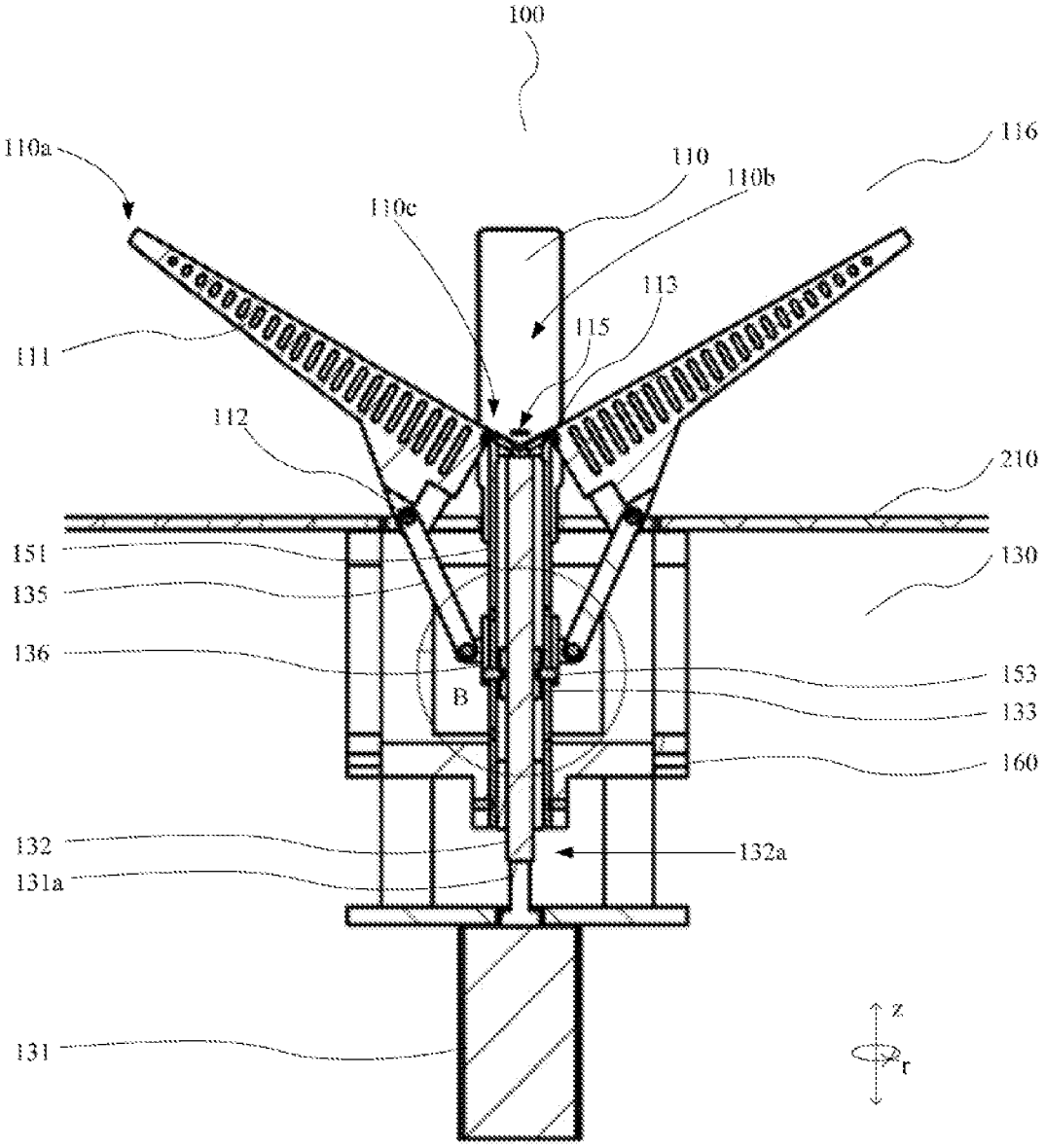
FIG. 2 is a sectional view of the burner of FIG. 1, taken along the section line A-A in FIG. 1.
Figure 4:
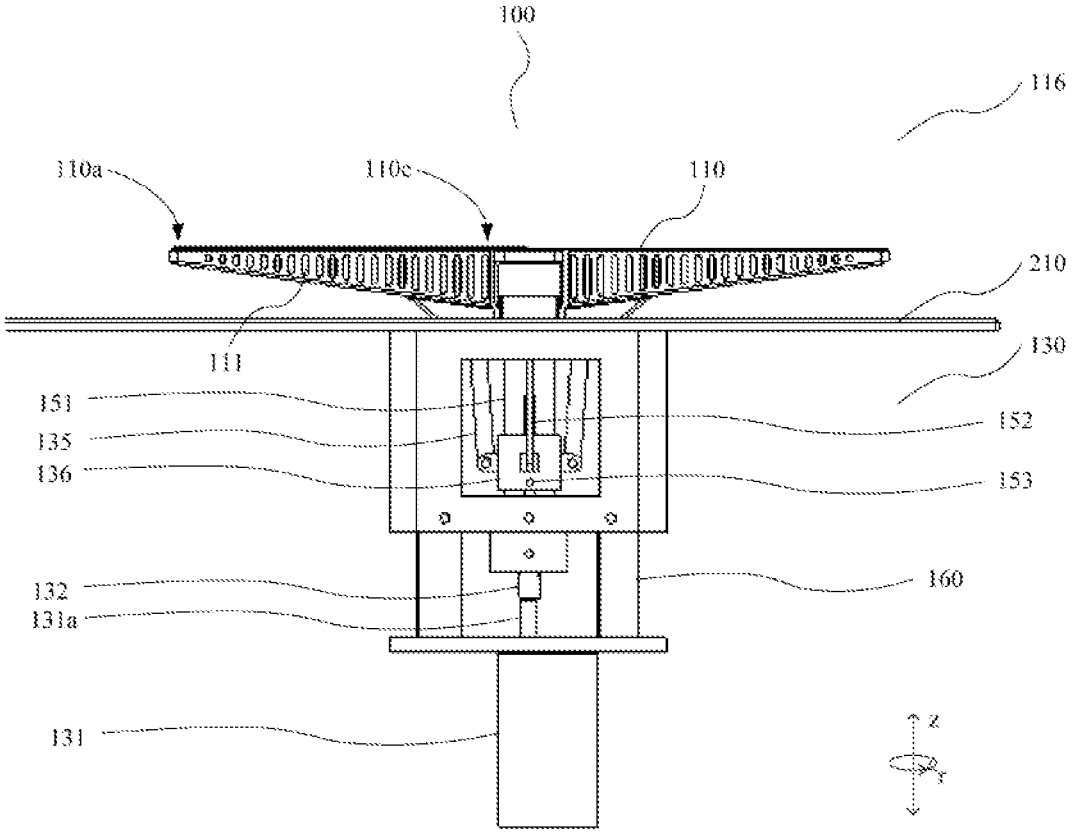
FIG. 4 is a schematic diagram of the burner shown in FIG. 1 in a second working position.

FIG. 1 and FIG. 2, which is a sectional view of the burner 100, taken along the section line A-A in FIG. 1, depict the brackets 110 in a first working position, and FIG. 4 shows the brackets 110 in a second working position in which the burner head 116 has a flat upper surface, i.e. each of the brackets 110 is in the second working position. When each of the brackets 110 is in the other first working position, the burner head 116 may be concave, as shown in FIGS. 1 and 2, i.e. each of the brackets 110 is in the first working position.

As a result, the burner head 116 can switch between a plurality of working positions to meet supporting and heating requirements of pots with different shapes. For example, when in the first working position shown in FIG. 1, the burner head 116 may be suitable for supporting a pot; and when in the second working position shown in FIG. 4, the burner head 116 may be suitable for supporting a pan.

Further, a linear motion direction of the linear motion mechanism 130 is indicated by a z direction in the drawings. Thus, the linear motion mechanism 130 can execute an up and down motion at an angle shown in the drawings, thereby driving each of the brackets 110 to switch between the first position shown in FIG. 1 and the second position shown in FIG. 4.

Of course, in addition to the first working position and the second working position shown in FIG. 1 and FIG. 4, each of the brackets 110 may further be placed in more than two working positions. A person skilled in the art can adjust an angle between the bracket 110 and a panel 210 of the gas cooktop as needed to better meet supporting requirements of pots with different shapes. The linear motion mechanism 130 can thus drive the bracket 110 to change the angle, so as to implement a switch of the burner head 116 between different working positions. Therefore, advantages of simple solutions, low costs, low structure complexity, and easy manufacture are achieved.

Each of the brackets 110 is held in the corresponding working position by the limit unit so as to provide a stable supporting structure and to avoid overturning of a pot supported on the bracket 110 due to an unexpected displacement of the bracket 110 during a use process.

Further, the brackets 110 can be held in different working positions, so that the burner head 116 can be made into different shapes to adapt to pots with different shapes and calibers.

The linear motion mechanism 130 may include a linear motor, a helical linear motion mechanism 130, or a linear motion mechanism 130 with a connecting rod. In this way, the bracket 110 can be effectively driven to rotate up and down about the rotating shaft 120 in a vertical direction (i.e., the z direction), so that the bracket 110 can switch between different working positions with a shortest motion.

For example, the linear motion mechanism 130 with a connecting rod may be a structure with four connecting rods, so that an effect that the bracket 110 is driven by the linear motion to rotate about the rotating shaft 120 in the z direction can also be achieved.

Figure 5:
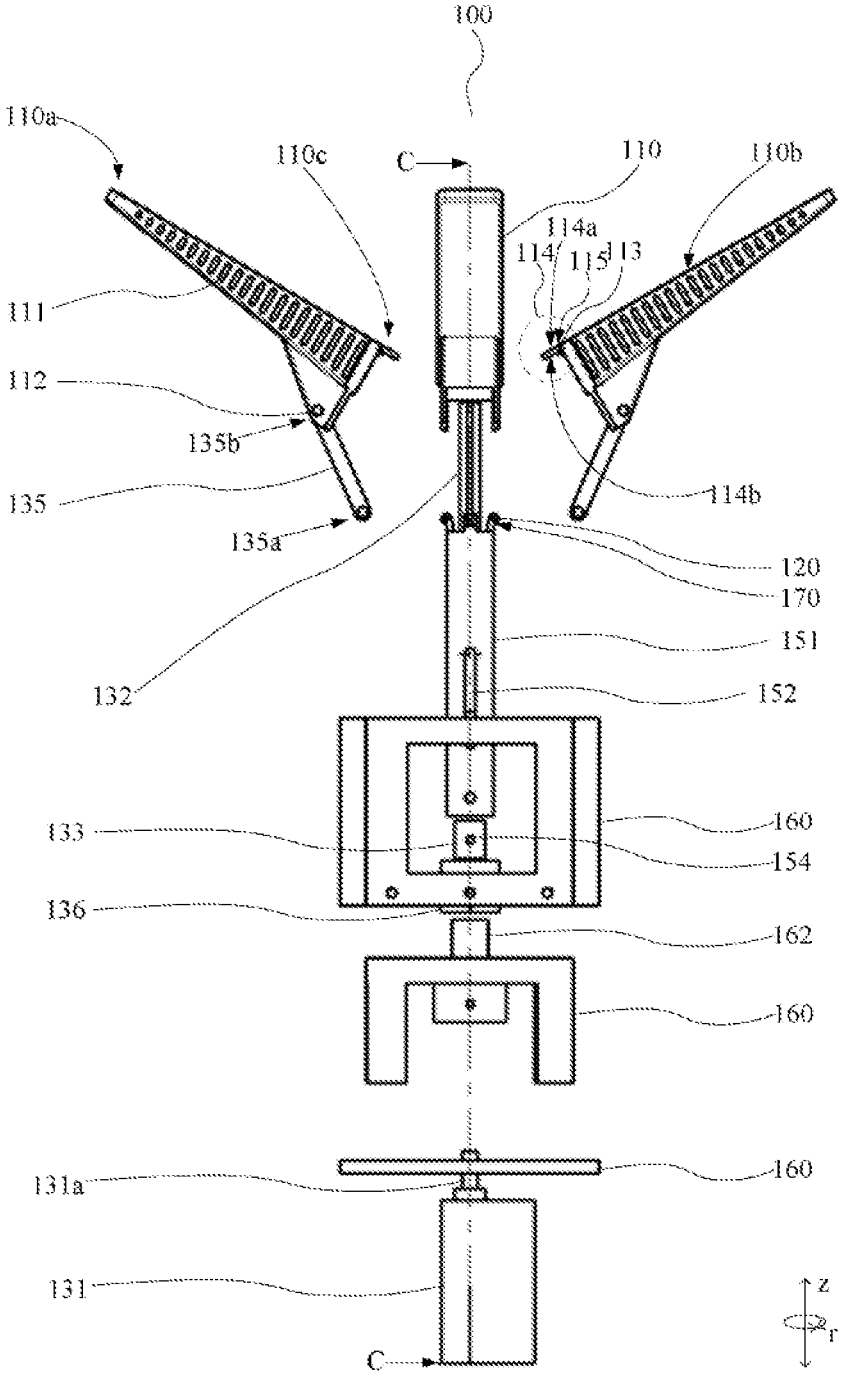
FIG. 5 is an exploded view of the burner of FIG. 1.
Figure 6:
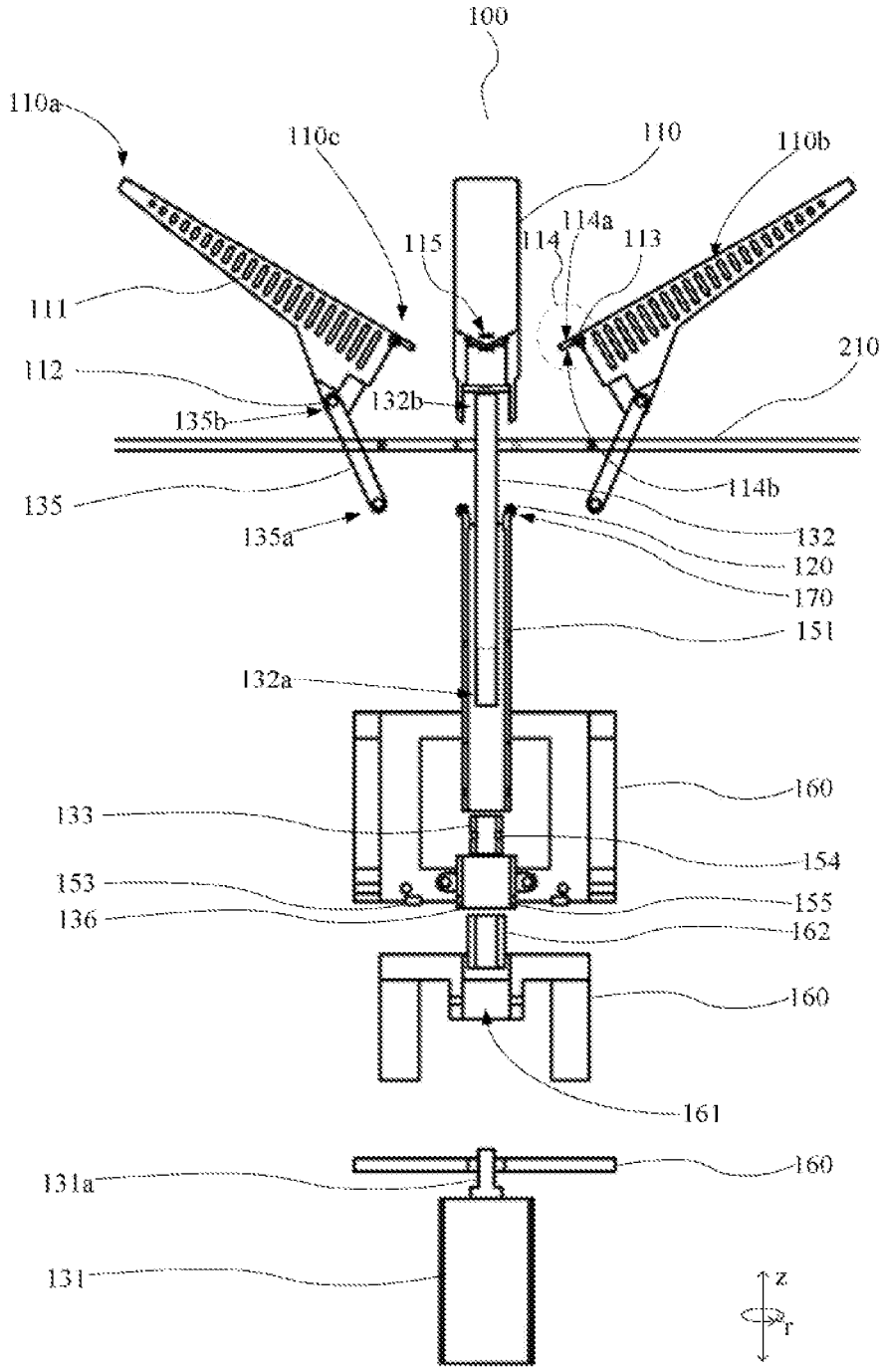
FIG. 6 is a sectional view of the burner, taken along a section line C-C in FIG. 5.

Referring now to FIGS. 5 and 6, there are shown an example of the linear motion mechanism 130 embodied as the helical linear motion mechanism. For ease of illustration, FIG. 5 omits depiction of the panel 210. The linear motion mechanism 130 may include: a driving portion 131; a transmission shaft 132 having a first end 132*a* coupled with the driving portion 131 and a second end 132*b*, with the first and second ends 132*a*, 132*b* being opposite to each other along a length direction. The transmission shaft 132 is driven by the driving portion 131 to rotate about its own axis r. A transmission portion 133 and a fixing unit 134 are mutually coupled, with the transmission portion 133 being sleeved on the transmission shaft 132, and limited by the fixing unit 134. The transmission portion 133 can perform an up and down motion along the transmission shaft 132 as the transmission shaft 132 rotates. The up and down motion refers hereby to a motion along the length direction of the transmission shaft 132 (i.e., a motion along the z direction). The linear motion mechanism 130 further includes a plurality of supporting rods 135, with each of the supporting rods 135 having a first end 135*a* and a second end 135*b* that are opposite to each other along a length direction. The first end 135*a* of each of the supporting rods 135 can be directly or indirectly hinged to the transmission portion 133, and the second end 135*b* of each of the supporting rods 135 is hinged to the corresponding bracket 110.

In this way, a rotational motion of the transmission shaft 132 is transformed into a linear motion of the transmission portion 133 through the cooperation of the components, and the linear motion is transmitted to the bracket 110 through the supporting rod 135.

Further, overall structure complexity of the linear motion mechanism 130 is low, the driving portion 131, the transmission shaft 132, the transmission portion 133, the fixing unit 134, and the supporting rod 135 can be combined through a simple splicing method, and are easy to assemble, and a processing technology of the components is simple.

In a non-restrictive embodiment, the driving portion 131 may be a rotary motor or another driving device capable of driving the transmission shaft 132 to rotate about its own axis r.

Further, the driving portion 131 may include a motor spindle 131*a*, and the first end 132*a* of the transmission shaft 132 may be coupled with the motor spindle 131*a* through a shaft sleeve (not shown in the drawings).

In a non-restrictive embodiment, the transmission portion 133 may be a trapezoidal nut, and the transmission shaft 132 may have a trapezoidal thread coupled with the trapezoidal nut. In this way, a helical transmission effect can be achieved, so that a rotational motion of the transmission shaft 132 can be transformed into a linear motion of the transmission portion 133 with the cooperation of the fixing unit 134.

Figure 7:
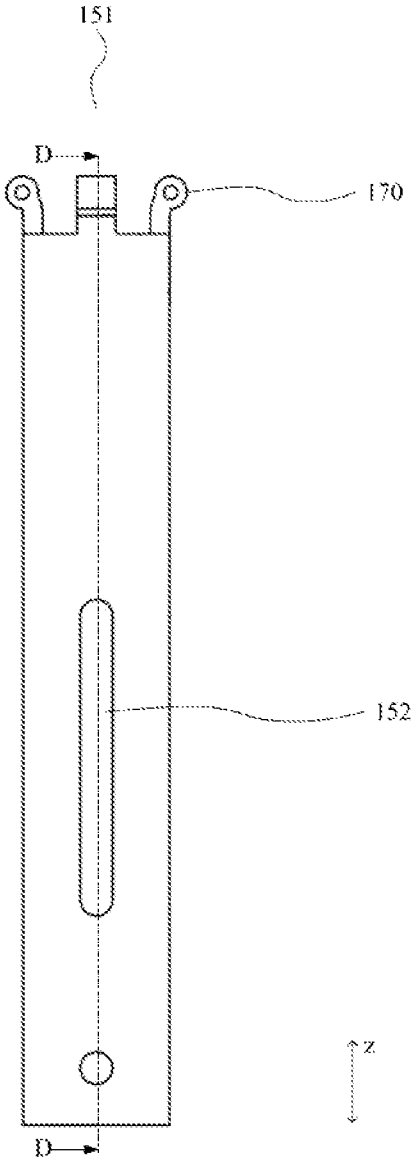
FIG. 7 is a schematic diagram of a guiding pillar of the burner.
Figure 8:
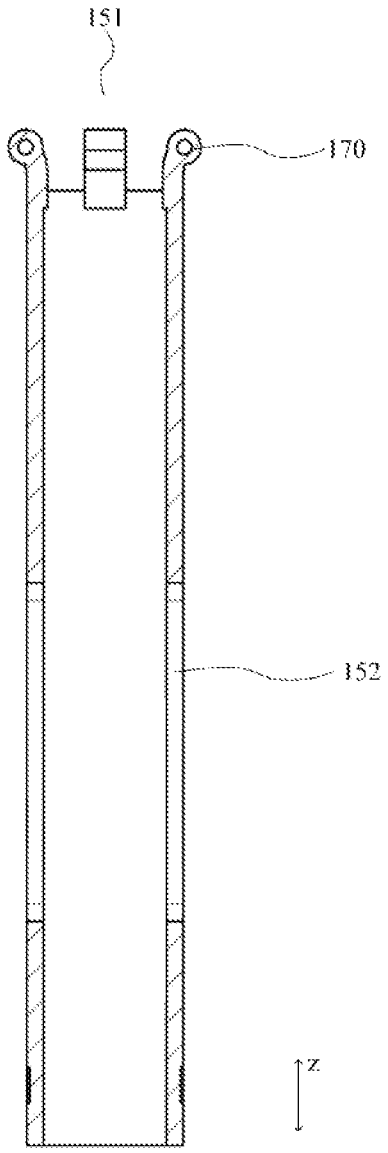
FIG. 8 is a sectional view of the guiding pillar in FIG. 7, taken along the section line D-D in FIG. 7.

Referring now to FIGS. 7 and 8, details of the fixing unit 134 will now be described. The fixing unit 134 includes a guiding pillar 151 which is sleeved on a periphery of the transmission shaft 132 and the transmission portion 133. The guiding pillar 151 is provided with a groove 152 along the length direction of the transmission shaft 132 (i.e., the z direction). A pin portion 153 of the fixing unit 134 has one end which extends into a first socket 154 arranged in the transmission portion 133, and the pin portion 153 is able to move up and down in the groove 152 to limit the transmission portion 133 from rotating with the rotation of the transmission shaft 132.

In this way, a rotational motion of the transmission portion 133 can be effectively transformed into a linear motion. Therefore, the structure is simple and easy to manufacture and assemble.

When the transmission shaft 132 is driven by the driving portion 131 to rotate about its own axis r, the transmission portion 133 sleeved on the transmission shaft 132 is driven to rotate together. However, because the transmission portion 133 is coupled with the pin portion 153, the rotational motion of the transmission portion 133 is blocked by the pin portion 153 and the groove 152 arranged on the guiding pillar 151 sleeved on the periphery of the transmission portion 133, so that the transmission portion 133 cannot rotate with the transmission shaft 132, but can only execute the linear motion in the z direction along the thread on the transmission shaft 132. In this way, a helical transmission effect can be achieved through the cooperation between the pin portion 153 and the groove 152. Therefore, space occupied by the entire linear motion mechanism 130 in the z direction can be effectively saved.

A length of the groove 152 along the length direction of the transmission shaft 132 can be determined based on a height difference between the bracket 110 in the first working position and the bracket 110 in the second working position, so as to ensure that the bracket 110 can be driven to the first working position or the second working position with the up and down motion of the transmission portion 133 (i.e., a motion along the z direction).

When the brackets 110 are able to assume more than two working positions, the length of the groove 152 along the length direction of the transmission shaft 132 may be determined by a height difference between a highest working position and a lowest working position that the bracket 110 assumes.

A width of the groove 152 may be coupled with a diameter of the pin portion 153 to ensure that the pin portion 153 can pass through the groove 152 and be coupled with the transmission portion 133, so as to block the pin portion 153 from rotating about the r axis. In this way, by blocking the rotation of the pin portion 153 through the groove 152, an effect of blocking the transmission portion 133 coupled with the pin portion 153 from rotating about the r axis can be achieved.

The width of the groove 152 may be slightly greater than the diameter of the pin portion 153 to avoid a problem of component damage caused by friction between the pin portion 153 and the groove 152 during the up and down motion of the transmission portion 133.

Figure 10:
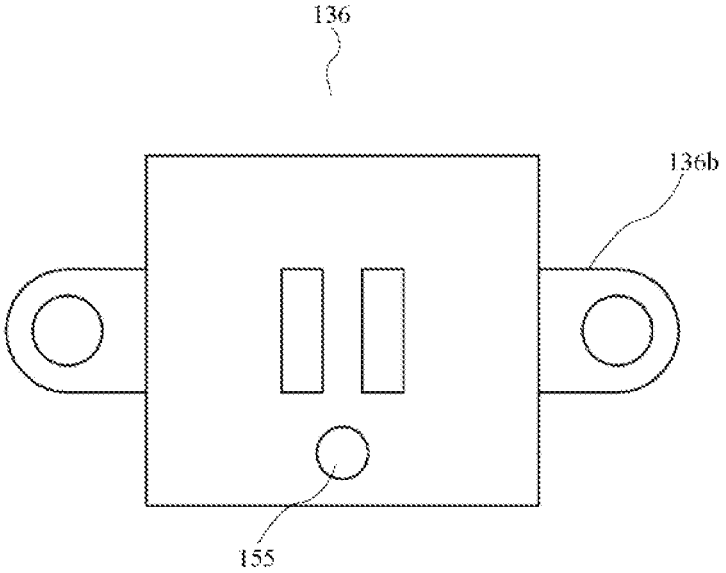
FIG. 10 is a schematic diagram of a slider of the burner.

As further shown in FIG. 5, the linear motion mechanism 130 can further include: a slider 136 which is shown in greater detail in FIG. 10 and is sleeved on a periphery of the guiding pillar 151. The slider 136 is fixed with the transmission portion 133 and performs the up and down motion with the transmission portion 133. As shown in particular in FIG. 3, the first end 135*a* of each of the supporting rods 135 is hinged to the slider 136. In this way, a linear motion of the transmission portion 133 can be transmitted to the supporting rod 135 via the slider 136 to thereby allow adjustment of an angle of the bracket 110.

Figure 3:
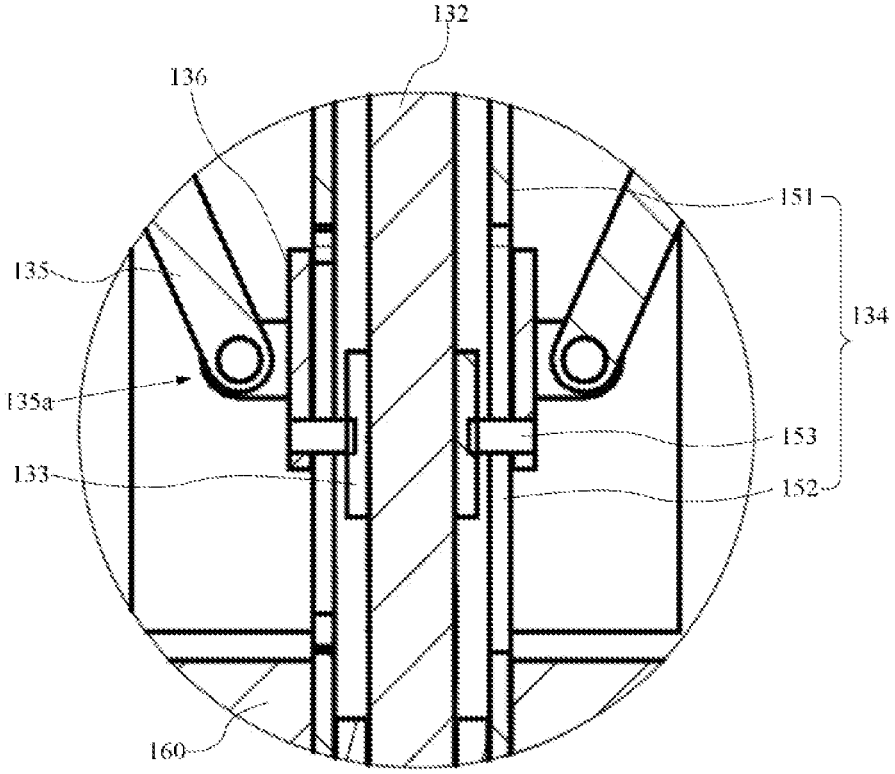
FIG. 3 is an enlarged detailed view of the region B encircled in FIG. 2 to show a linear motion mechanism of the burner in greater detail.
Figure 11:
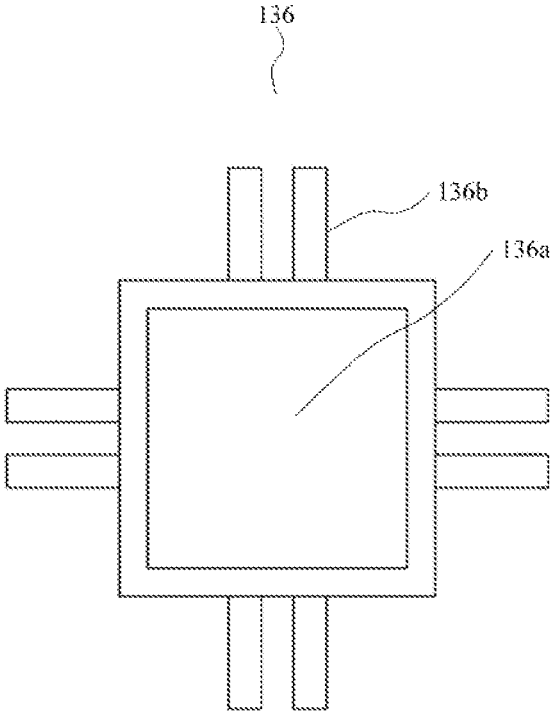
FIG. 11 is a top view of the slider.

For example, referring to FIG. 3 and FIG. 11, the slider 136 may be provided with a through hole 136*a* along the z direction. The transmission shaft 132, the transmission portion 133 sleeved on the transmission shaft 132, and the guiding pillar 151 sleeved on the periphery of the transmission shaft 132 and the transmission portion 133 pass through the through hole 136*a* to achieve an effect that the slider 136 is sleeved on a periphery of the guiding pillar 151.

Meanwhile, a position of a first socket 155 arranged on the slider 136 corresponds to a position of the groove 152 arranged on the guiding pillar 151 and a socket 154 arranged on the transmission portion 133, so that the pin portion 153 can pass through the socket 155 and the groove 152 and extend into the socket 154, thereby effectively fixing the slider 136 and the transmission portion 133, and limiting movement of the pin portion 153 to the groove 152.

As the guiding pillar 151 is sleeved on the periphery of the transmission shaft 132 and the transmission portion 133, the slider 136 may be coupled with a part of the transmission portion 133 exposed from the groove 152 so that the slider 136 can be fixed with the transmission portion 133 and move with the up and down motion of the transmission portion 133.

Optionally, a further hinge point 136*b* may be arranged on the slider 136, and the first end 135*a* of the supporting rod 135 may be hinged to the hinge point 136*b*. A quantity of hinge points 136*b* may be in accordance with a quantity of the supporting rods 135.

With reference to FIGS. 3, 6 and 10, the slider 136 may be provided with a second socket 155, with one end of the pin portion 153 passing through the second socket 155 and extending into the socket 154 on the transmission portion 133 to fix the slider 136 with the transmission portion 133. In this way, a synchronous motion of the slider 136 and the transmission portion 133 can be implemented on the basis of making full use of the existing components, a quantity of overall components can be reduced, and assembly complexity can be reduced.

For example, when the slider 136 has a cube structure, second sockets 155 may be arranged on four surfaces perpendicular to the z direction of the slider 136. Correspondingly, the guiding pillar 151 is provided with grooves 152 in four corresponding directions respectively, and the transmission portion 133 is provided with sockets 154 in the four corresponding directions respectively. In this way, an effect can be respectively achieved on the four surfaces of the slider 136 that the slider 136 and the transmission portion 133 are fixed through the pin portion 153, and perform the up and down motion together along the grooves 152, so that overall strength of the linear motion mechanism 130 can be optimized to better block the transmission portion 133 from rotating with the rotation of the transmission shaft 132 and to ensure implementation of a spiral motion.

The slider 136, the pin portion 153, and the transmission portion 133 may be formed integrally. For example, two ends of the pin portion 153 are respectively formed with the slider 136 and the transmission portion 133 to improve firmness of the overall structure and prolong a service life of the components.

As further shown in FIGS. 1 and 2 and FIGS. 4 to 6, the burner 100 of the gas cooktop may include a housing 160, which is arranged on a periphery of the linear motion mechanism 130. The housing 160 is provided with a through hole 161 for passage of the transmission shaft 132 on one side near the driving portion 131. In this way, the linear motion mechanism 130 can be protected by the housing 130, so that the linear motion mechanism 130 can be prevented from being damaged by external force collision during a use process.

FIG. 6 further shows the arrangement of a lining portion 162 around the through hole 161 to prevent the transmission shaft 132 driven by the driving portion 131 from swaying left and right during a rotation. The lining portion 162 may hereby wrap the transmission shaft 132 to prevent the transmission shaft 132 from swaying left and right while at the same time enhancing wear resistance and lubrication.

Figure 9:
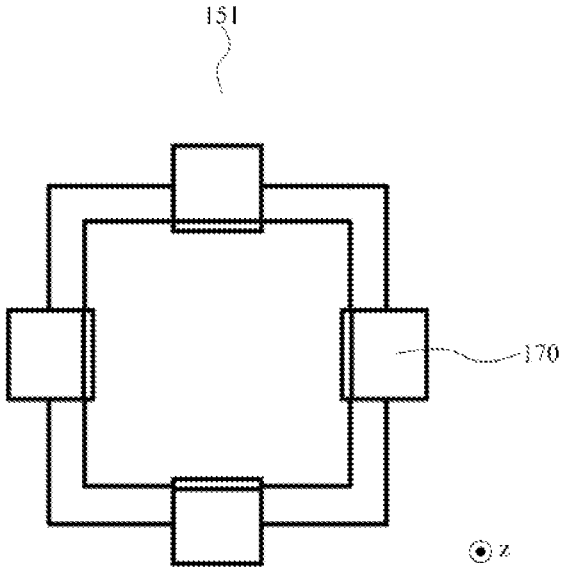
FIG. 9 is a top view of the guiding pillar in FIG. 7.

A quantity of the supporting rods 135 may be in accordance with a quantity of the brackets 110, with the second end 135*b* of each of the supporting rods 135 being hinged to a hinge point 112 of the corresponding bracket 110. As shown in particular in FIGS. 5-9, the linear motion mechanism 130 is provided with a supporting portion 170 on one end near the burner head 116. The rotating shaft 120 is fixed on the supporting portion 170, with a hinge point 113 of each of the brackets 110 being hinged to the rotating shaft 120. FIG. 9 is a top view of the guiding pillar 151 of the fixing unit 134 of the linear motion mechanism 130, depicting the provision of four support portions 170 for the brackets 110, respectively. When the linear motion mechanism 130 executes a linear motion, the hinge point 112 of each of the brackets 110 rotates about the hinge point 113 of the brackets 110. In this way, with the linear motion of the linear motion mechanism 130, the angle of the bracket 110 can be changed. Therefore, the bracket 110 can switch between different working positions.

Further, as the hinge point 112 of each of the brackets 110 rotates about the hinge point 113, one end 110*a* of each of the brackets 110 away from a center 116*a* of the burner head 116, as shown in FIG. 2, can move in a direction away from or close to panel 210 of the gas cooktop. Therefore, a flat or a concave burner head is formed to stabilize and support pots with different shapes and calibers.

The hinge point 112 of the brackets 110 may be located at a lower end of the bracket 110, and the hinge point 113 of the brackets 110 may be located at one end 110*c* of an upper surface 110*b* of the bracket 110 near the burner head center 116*a*. In this way, a length of the supporting rod 135 can be reasonably shortened to reduce costs, and an effect that one end 110*a* of the bracket 110 away from the burner head center 116*a* can rotate about another end 110*c* close to the burner head center 116*a* can be achieved.

Figure 12:
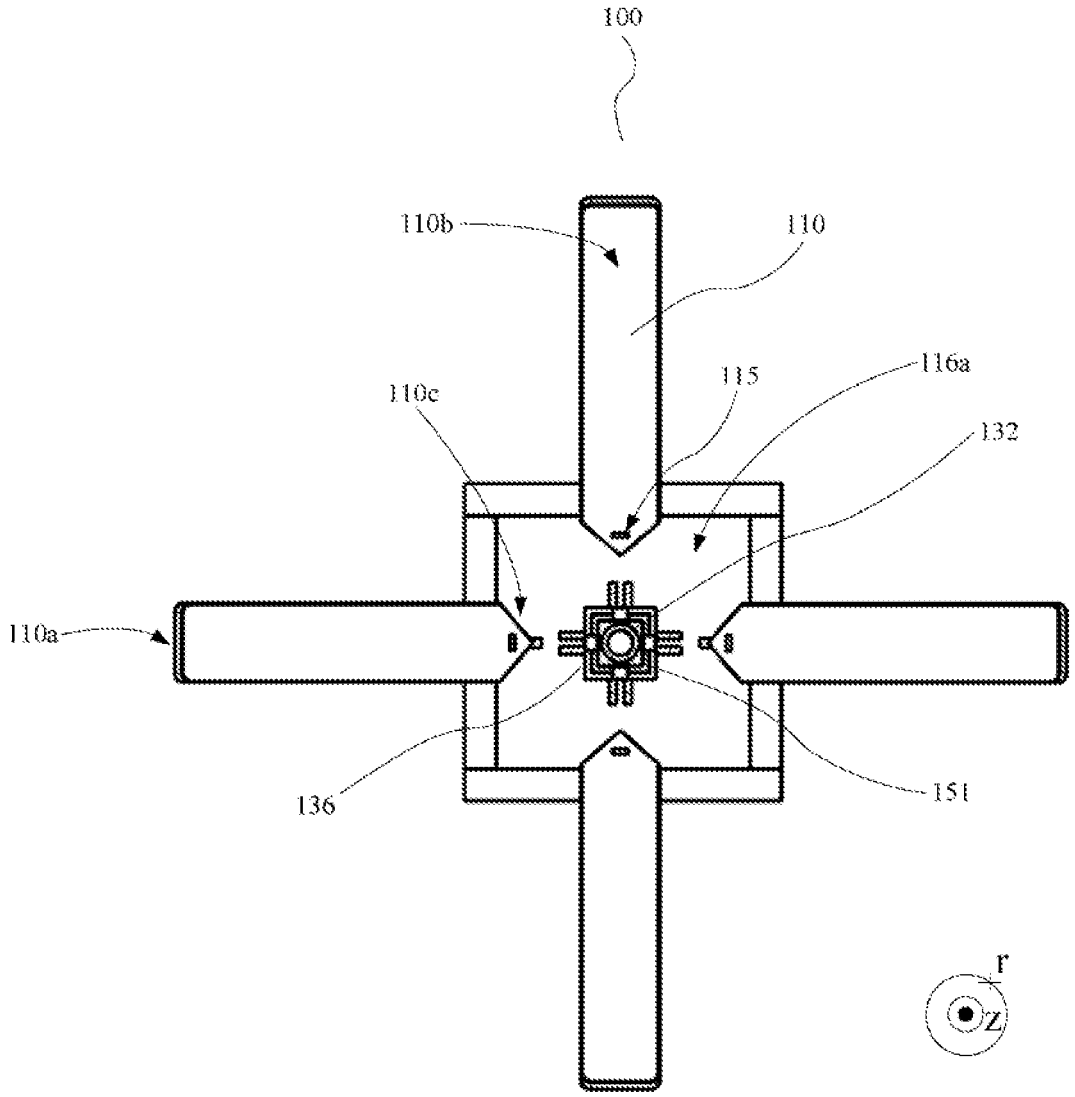
FIG. 12 is a top view of the burner of FIG. 1.

As further shown in FIGS. 5 and 6, the bracket 110 can have a protruded portion 114 extending to the burner head center 116*a*. The protruded portion 114 is provided with a through hole 115, which is readily apparent from FIG. 12 and runs through an upper surface 114*a* and a lower surface 114*b* of the protruded portion 114. The supporting portion 170 is fixed with one end of the rotating shaft 120 and extends into the through hole 115 to hinge the bracket 110 to the rotating shaft 120. In this way, the supporting portion 170 passes through the bracket 110 and is hinged to the inside of the bracket 110, so that the hinged position is not easily damaged by external forces, and is conducive to prolonging a service life of the burner head 116.

Optionally, the upper surface 114*a* of the protruded portion 114 may be level with the upper surface 110*b* of the bracket 110 to form a flat upper surface when the burner head 116 is in the second working position.

The limit unit may include micro switches at a quantity in accordance with a quantity of the working positions. When the linear motion mechanism 130 executes a linear motion until the micro switch is touched, the linear motion mechanism 130 stops performing the linear motion so that the bracket 110 remains in the corresponding working position. In this way, the linear motion mechanism 130 can automatically stop operation, so that after driven to move to a suitable working position, the bracket 110 can automatically remain in the working position for users to use.

Micro switches of the limit unit may be placed at the two ends of the groove 152 along a length direction of the two parallel grooves 152, to ensure that the transmission shaft 132 is blocked from continuing to rotate when the slider 136 moves along the z direction to a top or a bottom of the groove 152, so that the bracket 110 remains in the first working position or the second working position.

For example, the micro switch may be arranged in a position in the housing 160 coupled with the pin portion 153. In this way, the micro switch is touched by the pin portion 153 and stops the driving portion 131 when the pin portion 153 moves with the slider 136, i.e., the driving portion 131 stops driving the transmission shaft 132 to continue to rotate, so that the bracket 110 remains in the first working position or the second working position.

As an alternative, the motion of the linear motion mechanism 130 may also be restricted by the limit units through programs.

The driving portion 131 can be embodied as a rotary motor. Limit programs may be embedded in operating programs of the rotary motor. For example, a quantity of rotating cycles of the motor moving from the first working position to the second moving position is set. In actual operations, when the quantity of rotating cycles of the rotary motor reaches the set value, the rotary motor is controlled to automatically stop running. Therefore, the linear motion mechanism 130 is effectively restricted and unable to continue to execute the linear motion. As a result, the bracket 110 is securely held in the first working position or the second working position.

Another aspect of the present invention involves the provision of a gas cooktop, which is provided with a movable burner 100 as described above and shown in FIGS. 1-12. The burner head 116 of the gas cooktop can thus switch between a plurality of working positions, and can adapt to pots with different shapes and calibers.

The burner head 116 of the burner 100 may be located above the panel 210, and the linear motion mechanism 130 of the burner 100 may be located below the panel 210 and thus invisible to users, thereby optimizing user experience.

Although the present invention is disclosed as above, the present invention is not limited thereto. Any person skilled in the art can make various changes and modifications without departing from the spirit and scope of the present invention. Therefore, the protection scope of the present invention shall be subject to the scope defined by the claims.

What is claimed is:

1. A movable burner of a gas cooktop, comprising:

a rotating shaft;

a linear motion mechanism configured to perform a linear motion;

a burner head comprising a plurality of brackets including a plurality of gas outlets for gas to flow out and form a flame, each of the brackets being separately hinged to the rotating shaft and separately connected to the linear motion mechanism such as to execute a rotation about the rotating shaft between at least two working positions, when driven by the linear motion mechanism, with the burner head having a flat upper surface in one of the two working positions, and with the burner head having a concave configuration in the other one of the two working positions; and a limit unit configured to limit a stroke range of the linear motion mechanism.

2. The burner of claim 1, wherein the linear motion mechanism to effect the linear motion is configured in one of three ways, a first way in which the linear motion mechanism comprises a linear motor to effect the linear motion, a second way in which the linear motion mechanism is embodied as a helical linear motion mechanism to effect the linear motion, a third way in which the linear motion mechanism comprises a connecting rod to effect the linear motion.

3. The burner of claim 1, wherein the linear motion mechanism comprises:

a driving portion, a transmission shaft driveable by the driving portion for rotation about its own axis, said transmission shaft having first and second ends that are opposite to each other along a length direction, with the first end coupled with the driving portion, a transmission portion sleeved on the transmission shaft and executing an up and down motion in the length direction along the transmission shaft as the transmission shaft rotates, a fixing unit coupled to the transmission portion to limit a rotation of the transmission portion when the transmission shaft is caused to rotate, and a plurality of supporting rods, each of the supporting rods having first and second ends that are opposite to each other along a length direction, with the first end being directly or indirectly hinged to the transmission portion, and with the second end of each of the supporting rods being hinged to a corresponding one of the brackets.

4. The burner of claim 3, wherein the fixing unit comprises:

a guiding pillar sleeved on a periphery of the transmission shaft and the transmission portion, said guiding pillar provided with a groove along the length direction of the transmission shaft, and a pin portion having one end extending into a socket arranged in the transmission portion and capable of moving up and down in the groove while limiting the transmission portion from rotating when the transmission shaft is caused to rotate.

5. The burner of claim 4, wherein the linear motion mechanism comprises a slider sleeved on a periphery of the guiding pillar, said slider being fixed with the transmission portion and caused to move up and down during the up and down motion of the transmission portion, wherein the first end of the supporting rods is hinged to the slider.

6. The burner of claim 5, wherein the slider includes a socket, said pin portion passing through the socket of the slider and extending with the one end into the socket of the transmission portion to fix the slider with the transmission portion.

7. The burner of claim 3, wherein the transmission portion is configured as a trapezoidal nut, said transmission shaft having a trapezoidal thread coupled with the trapezoidal nut.

8. The burner of claim 3, further comprising a housing arranged on a periphery of the linear motion mechanism, said housing provided with a through hole for passage of the transmission shaft on one side near the driving portion.

9. The burner of claim 3, wherein the supporting rods are connected to the brackets in one-to-one correspondence, with the second end of each of the supporting rods being hinged to a first hinge point of the corresponding one of the brackets, said linear motion mechanism being provided with a supporting portion on one end near the burner head, with the rotating shaft being fixed on the supporting portion and hinged to the brackets at a second hinge point of each of the brackets so that the linear motion of the linear motion mechanism causes a rotation of the first hinge point of each of the brackets about the second hinge point.

10. The burner of claim 9, wherein the first hinge point is located at a lower end of the corresponding one of the brackets, and the second hinge point is located at one end of an upper surface of the corresponding one of the brackets near a center of the burner head.

11. The burner of claim 10, wherein the corresponding one of the brackets includes a protruded portion extending to the center of the burner head and provided with a through hole running through an upper surface and a lower surface of the protruded portion, said supporting portion being fixed with one end of the rotating shaft and extending into the through hole of the protruding portion to hinge the corresponding one of the brackets to the rotating shaft.

12. The burner of claim 1, wherein the limit unit comprises micro switches respectively provided for the at least two working positions and configured to stop the linear motion of the linear motion mechanism, when being touched, so that the brackets remain in the corresponding one of the at least two working positions.

13. A gas cooktop, comprising a movable burner, said movable burner comprising:

a rotating shaft, a linear motion mechanism configured to perform a linear motion, a burner head comprising a plurality of brackets including a plurality of gas outlets for gas to flow out and form a flame, each of the brackets being separately hinged to the rotating shaft and separately connected to the linear motion mechanism such as to execute a rotation about the rotating shaft between at least two working positions, when driven by the linear motion mechanism, with the burner head having a flat upper surface in one of the two working positions, and with the burner head having a concave configuration in the other one of the two working positions, and a limit unit configured to limit a stroke range of the linear motion mechanism.

14. The gas cooktop of claim 13, wherein the linear motion mechanism to effect the linear motion is configured in one of three ways, a first way in which the linear motion mechanism comprises a linear motor to effect the linear motion, a second way in which the linear motion mechanism is embodied as a helical linear motion mechanism to effect the linear motion, a third way in which the linear motion mechanism comprises a connecting rod to effect the linear motion.

15. The gas cooktop of claim 13, wherein the linear motion mechanism comprises:

a driving portion, a transmission shaft driveable by the driving portion for rotation about its own axis, said transmission shaft having first and second ends that are opposite to each other along a length direction, with the first end coupled with the driving portion, a transmission portion sleeved on the transmission shaft and executing an up and down motion in the length direction along the transmission shaft as the transmission shaft rotates, a fixing unit coupled to the transmission portion to limit a rotation of the transmission portion when the transmission shaft is caused to rotate, and a plurality of supporting rods, each of the supporting rods having first and second ends that are opposite to each other along a length direction, with the first end being directly or indirectly hinged to the transmission portion, and with the second end of each of the supporting rods being hinged to a corresponding one of the brackets.

16. The gas cooktop of claim 15, wherein the fixing unit comprises:

a guiding pillar sleeved on a periphery of the transmission shaft and the transmission portion, said guiding pillar provided with a groove along the length direction of the transmission shaft, and a pin portion having one end extending into a socket arranged in the transmission portion and capable of moving up and down in the groove while limiting the transmission portion from rotating when the transmission shaft is caused to rotate.

17. The gas cooktop of claim 16, wherein the linear motion mechanism comprises a slider sleeved on a periphery of the guiding pillar, said slider being fixed with the transmission portion and caused to move up and down during the up and down motion of the transmission portion, wherein the first end of the supporting rods is hinged to the slider.

18. The gas cooktop of claim 17, wherein the slider includes a socket, said pin portion passing through the socket of the slider and extending with the one end into the socket of the transmission portion to fix the slider with the transmission portion.

19. The gas cooktop of claim 15, wherein the transmission portion is configured as a trapezoidal nut, said transmission shaft having a trapezoidal thread coupled with the trapezoidal nut.

20. The gas cooktop of claim 15, wherein the burner includes a housing arranged on a periphery of the linear motion mechanism, said housing provided with a through hole for passage of the transmission shaft on one side near the driving portion.

21. The gas cooktop of claim 15, wherein the supporting rods are connected to the brackets in one-to-one correspondence, with the second end of each of the supporting rods being hinged to a first hinge point of the corresponding one of the brackets, said linear motion mechanism being provided with a supporting portion on one end near the burner head, with the rotating shaft being fixed on the supporting portion and hinged to the brackets at a second hinge point of each of the brackets so that the linear motion of the linear motion mechanism causes a rotation of the first hinge point of each of the brackets about the second hinge point.

22. The gas cooktop of claim 21, wherein the first hinge point is located at a lower end of the corresponding one of the brackets, and the second hinge point is located at one end of an upper surface of the corresponding one of the brackets near a center of the burner head.

23. The gas cooktop of claim 22, wherein the corresponding one of the brackets includes a protruded portion extending to the center of the burner head and provided with a through hole running through an upper surface and a lower surface of the protruded portion, said supporting portion being fixed with one end of the rotating shaft and extending into the through hole of the protruding portion to hinge the corresponding one of the brackets to the rotating shaft.

24. The gas cooktop of claim 13, wherein the limit unit comprises micro switches respectively provided for the at least two working positions and configured to stop the linear motion of the linear motion mechanism, when being touched, so that the brackets remain in the corresponding one of the at least two working positions.

* * * * *